US008829823B2

(12) United States Patent
Teske et al.

(10) Patent No.: US 8,829,823 B2
(45) Date of Patent: Sep. 9, 2014

(54) INDUCTION SWITCH

(75) Inventors: Christian Teske, Frankfurt am Main (DE); Joachim Jacoby, Lörzweiler (DE)

(73) Assignee: Johann Wolfgang Goethe—Universität Frankfurt am Main, Frankfurt am Main (DE)

( * ) Notice: Subject to any disclaimer, the term of this patent is extended or adjusted under 35 U.S.C. 154(b) by 497 days.

(21) Appl. No.: 13/124,189

(22) PCT Filed: Sep. 17, 2009

(86) PCT No.: PCT/EP2009/006738

§ 371 (c)(1), (2), (4) Date: Jun. 10, 2011

(87) PCT Pub. No.: WO2010/043294

PCT Pub. Date: Apr. 22, 2010

(65) Prior Publication Data

US 2011/0234101 A1 Sep. 29, 2011

(30) Foreign Application Priority Data

Oct. 17, 2008 (DE) ..... 10 2008 052 216

(51) Int. Cl.
*H01J 11/04* (2006.01)
*H01J 7/24* (2006.01)

(52) U.S. Cl.
USPC ..... 315/344; 315/111.41; 315/338

(58) Field of Classification Search
CPC ..... B23H 1/022; B23H 2300/20; B23H 7/04; F21L 7/00; F21V 15/04
USPC ..... 315/111.21
See application file for complete search history.

(56) References Cited

U.S. PATENT DOCUMENTS

| | | | | |
|---|---|---|---|---|
| 4,589,123 | A * | 5/1986 | Pearlman et al. | 378/106 |
| 4,812,715 | A * | 3/1989 | Mendel | 315/340 |
| 5,126,638 | A | 6/1992 | Dethlefsen | 315/326 |

(Continued)

FOREIGN PATENT DOCUMENTS

| | | | | |
|---|---|---|---|---|
| DE | 39 42 307 | A1 | 7/1991 | H01J 17/04 |
| DE | 10 2007 039 758 | A1 | 3/2009 | H05H 1/46 |
| RU | 2243612 | C1 | 12/2004 | H01J 17/40 |
| WO | WO 2006/130036 | A1 | 7/2006 | H01J 17/44 |

OTHER PUBLICATIONS

Teske, Doctoral Dissertation, Johann Wolfgang Goethe-Universität Franfurt am Main, pp. 129-135, 2007.

(Continued)

*Primary Examiner* — Thienvu Tran
(74) *Attorney, Agent, or Firm* — Sunstein Kann Murphy & Timbers LLP

(57) ABSTRACT

The invention relates to an induction switch comprising a discharge container filled with gas and a coaxially interleaved electrode device, and to a corresponding method for commutating high voltages. The inductive production of a dense plasma and the subsequent flooding of an electrode gap with the plasma ions produced enables the commutation of high currents in the kiloamp range when there are blocking voltages of over 500 kV. Such an induction switch only requires a single discharge gap, can be used over a very wide voltage range, and avoids the problem of electrode erosion as a result of the electrode-free energy coupling.

25 Claims, 5 Drawing Sheets

(56) References Cited

U.S. PATENT DOCUMENTS

| | | | | |
|---|---|---|---|---|
| 5,352,994 | A * | 10/1994 | Black et al. | 333/33 |
| 5,608,297 | A * | 3/1997 | Goebel | 315/344 |
| 6,304,042 | B1 * | 10/2001 | Savage et al. | 315/340 |
| 6,605,177 | B2 * | 8/2003 | Mett et al. | 156/345.53 |
| 2003/0037883 | A1 * | 2/2003 | Mett et al. | 156/345.51 |
| 2005/0099133 | A1 * | 5/2005 | Quon et al. | 315/111.01 |
| 2010/0326602 | A1 * | 12/2010 | Bluck et al. | 156/345.53 |
| 2011/0049101 | A1 * | 3/2011 | Juco et al. | 216/71 |

OTHER PUBLICATIONS

Eric Bijn, Authorized Officer European Patent Office, International Search Report and Written Opinion, Nov. 24, 2009, PCT/EP2009/006738.

* cited by examiner

INDUCTION SWITCH

FIELD OF THE INVENTION

The invention relates to high voltage switches for switching currents in the kA range and in particular to high voltage switches which are switched by means of an inductively generated plasma discharge.

PRIOR ART

For switching high voltage sources, two groups of switches are known, gas discharge switches and semiconductor switches, which operate according to different physical principles.

Gas discharge switches switch high currents by generating an arc discharge in a switch tube filled with a gas which can be ionised. An example is the thyratron, a tube rectifier with a hot cathode, which can be controlled by means of a grid and the structure of which is similar to a triode. An arc discharge, which turns the entire interspace into a conductive plasma, is initiated between the anode and cathode by application of a suitable control voltage to the grid electrode. The anode current can reach several thousand amperes depending on the configuration. Mercury vapour, xenon, neon, krypton or hydrogen are for example used as the gas fill.

A disadvantage of the thyratron lies in the fact that the electrode surface of both the anode and the cathode is subject to severe erosion and thus high wear owing to the high current and power densities which arise. The trigger system is therefore often completely destroyed or becomes unusable due to sputter effects after only a few thousand switching operations.

Laser triggers often cited in the technical literature avoid this problem and make possible very good switching characteristics, but are technically very complex (YAG laser with complex optics) and therefore currently unsuitable for standardised switch systems.

In order to reduce the disadvantageous wear of the trigger system, what are known as low pressure plasma switches are used, in which the plasma carrying the current can propagate widely over the electrodes. Such switches are however also limited to maximum reverse voltages of approximately 40 kV.

In what are known as multi-channel pseudospark switches, the discharge current is distributed over a plurality of channels, so that the current and power density per channel can be reduced. One embodiment is disclosed by the application DE 39 42 307 A1. As well as the increased outlay on design, the disadvantage of multi-channel pseudospark switches is also the increased requirements for triggering, as simultaneous initiation of all the discharge channels must be ensured.

A further example of a gas discharge switch is what is known as the ignitron, a mercury vapour rectifier with a mercury pool electrode, which can be controlled by means of an ignition electrode. The ignitron consists of a metal container which is filled in a lower section with mercury which forms the cathode of the switch during operation. A solid graphite anode is set into the upper region of the metal container. An ignition electrode in the lower region of the metal container triggers ionisation of the mercury vapour so that a mercury plasma rapidly forms between the mercury pool and the anode, in which plasma an arc discharge can be initiated. Ignitrons can switch current intensities in the range of several hundred kiloamperes with reverse voltages up to 50 kV. However, the defined switch-on characteristics are exhausted very quickly owing to the high rate of electrode erosion (as in the thyratron).

Modern gas discharge switches are described for example in laid-open specification DE 42 14 362 A1 and patent specification DE 197 53 695 C1.

Owing to the disadvantages of gas discharge switches mentioned, high voltage switches are currently mostly based on the use of semiconductor components. One example of a controllable rectifier consisting of a multi-layer semiconductor is the thyristor, which has three p-n junctions. Thyristors are used for switching large currents of up to more than 10 kA. Alternatively, bipolar transistors with an insulated gate electrode (insulated gate bipolar transistor, IGBT) are used, which have more advantageous switching characteristics. To switch higher voltages using thyristors or IGBTs, a series connection of a plurality of components is however always necessary, which becomes uneconomical at voltages above 20 kV. In addition, rates of current rise of more than 10 kA/μs can hardly be reached at present with the semiconductor components.

There is therefore a need for a high voltage switch which avoids the disadvantages mentioned, makes it possible to switch high currents at reverse voltages in the range of several 100 kV and at high rates of current rise, and at the same time circumvents the problem of electrode erosion.

SUMMARY OF THE INVENTION

This object is achieved by an induction switch with the features of Claim 1 and by the method for switching high voltages with the features of Claim 18. The dependent claims relate to advantageous embodiments.

The induction switch according to the invention comprises a container with a gas in which a plasma is to be generated, an inductor which can be coupled inductively with the gas, and a power source for generating an AC signal in the inductor. The induction switch further comprises an electrode device in the interior of the container with an electrode gap between an inner electrode and an outer electrode, wherein the outer electrode has at least one aperture and the inner electrode is fully or partially enclosed.

The plasma generated in the container is drawn into the electrode gap with the aid of the electrode device and there results in the immediate formation of a charge channel between the inner electrode and the outer electrode, as a result of which the switch changes to the closed state.

Because the discharge plasma is generated in a purely inductive manner, the usual disadvantages of electrode-supported energy coupling, in particular electrode erosion, are completely eliminated. As the components of the trigger system are not exposed to the discharge plasma, the service life of the induction switch according to the invention corresponds to the service life of the electrode gap system. In addition, the trigger discharge can be initiated over the entire circumference of the discharge vessel and thus over the longest distance. It can thereby be ensured that the switch gap has a working point far on the left branch of the Paschen curve, whereas the trigger mechanism operates in the associated Paschen minimum.

The plasma is preferably generated by low-frequency inductive excitation using the method described in the German patent application DE 10 2007 039 758 of the same applicant. This makes it possible to generate a discharge plasma with particularly high charge carrier densities and thus allows the advantage of very high conductivity of the trigger plasma, which results in immediate flashover when the plasma penetrates the electrode gap.

In addition, the induction switch according to the invention can be used over a very wide voltage range, which extends from a few tens of volts to a few 100 kV, owing to the high level of conductivity of the trigger discharge.

A further advantage of the induction switch according to the invention lies in the fact that the working point of the trigger system can be reduced far into the low pressure range. This means that the electrode gap distance can be raised into the range of several millimeters to centimeters, so that a very high reverse voltage is produced with only one electrode type owing to the reduced electrical field strength.

The effective Lorentz forces during the inductive plasma generation also promote forced penetration of the plasma through the aperture into the electrode gap between the inner electrode and the outer electrode. This increases the switching speed.

In a preferred embodiment, the inner electrode and the outer electrode are cylindrical, and the outer electrode encloses the inner electrode at least partially coaxially.

The outer electrode and the inner electrode can be configured both as straight circular cylinders and as cylinders with an elliptical base area, as a prism or as another straight or sloped cylinder. Cylinder within the meaning of the application means any body which can be imagined as being produced by moving a flat face or closed curve along a straight line. Differently shaped electrodes are also to be understood as cylindrical electrodes within the meaning of the invention, as long as the deviation from the cylindrical shape is slight or essential components of the electrodes are cylindrical.

In a preferred embodiment, the outer electrode is a hollow circular cylinder, whereas the inner electrode is a hollow or solid circular cylinder. Alternatively, ellipsoid or spherical electrodes can also be used.

In a further preferred embodiment, the container is spherical or approximately spherical, the cylinder axis of the outer electrode running through the centre point of the sphere. A spherical container has the advantage that it has a large ratio between volume and surface area, so that surface losses during the inductive plasma generation can be reduced and a plasma with particularly high electron density is produced. In this respect, a spherical container is particularly suitable for the purposes of the invention. An "approximately spherical" container in the present specification is a container with a shape that is similar to a spherical container at least to the extent that it has a ratio of volume to surface area which deviates from that of an exactly spherical container of the same volume by less than one fifth.

As the cylinder axis of the outer electrode runs through the centre point of the sphere, the plasma extraction effects a compression of the plasma in the electrode gap and a simultaneous and uniform penetration of the plasma ions from the various radial directions into the electrode gap and thus a particularly advantageous switching characteristic.

In an advantageous embodiment, the width of the electrode gap is more than 2 mm, preferably more than 4 mm.

In a further preferred embodiment, the outer electrode has a plurality of apertures along an axial direction, in each case two apertures being separated by a web.

The gas preferably comprises a inert gas, preferably argon, and the gas pressure is less than 30 Pa, preferably less than 10 Pa.

In a further advantageous embodiment, the inductance L of the inductor is 0.5 μH to 10 μH, preferably 1 μH to 6 μH.

In a preferred embodiment, the inductor comprises a coil which surrounds the container. The number of windings of the coil can be in particular in the range between 2 and 4.

In a further preferred embodiment, the length of the apertures along an axial direction of the outer electrode corresponds to the extent of a section of the container which is surrounded by the coil. This ensures that the plasma generated inductively in the container can flow over the entire width of the plasma generation region through the aperture into the electrode gap. A particularly advantageous switching characteristic is produced in this manner.

In a preferred embodiment, the power source comprises at least one capacitor, which can be charged to an operating voltage, and at least one switching element, which can be switched into a conductive state and is connected in such a manner that the at least one capacitor can discharge through the inductor when the switching element is in the conductive state. As explained below with reference to an exemplary embodiments, in such a structure and using modern power switching elements, high rates of current rise can be achieved, which result in an ignition of a plasma with high charge carrier densities even at comparatively low excitation frequencies.

The at least one capacitor and the inductor preferably form components of an electrical oscillator circuit which is not overdamped, and the natural frequency of which corresponds to a frequency of the AC signal. According to this embodiment, the AC signal is thus formed in an electrical oscillator circuit which contains the capacitor and the inductor. The inductance L and the capacitance C of the capacitor can then be tuned in such a manner that the oscillator circuit oscillates at the desired excitation frequency. The oscillator circuit executes a damped oscillation owing to the ohmic resistance of the inductor, in particular however owing to the inductive coupling of the inductor with the plasma which is necessary for plasma excitation. Because of the two damping sources, on the one hand a natural frequency which is reduced compared to the undamped oscillator circuit and on the other hand an attenuation of the damped oscillation over time are produced. The term "AC signal" within the meaning of the present invention does not therefore necessarily mean a CW signal; the term also includes a damped oscillation with possibly only a few zero crossings.

The switching element of the power source preferably comprises at least one thyristor, at least one IGBT or at least one gas discharge switch, for example a thyratron or an ignitron.

The at least one capacitor or a plurality of parallel-connected capacitors preferably have a total capacitance of from 1 μF to 100 μF, preferably of from 6 μF to 20 μF.

As can be seen in the above-described parameter ranges, the power source must be designed to switch relatively high currents with comparatively high rates of current rise in the range of up to 3 kA/μs. As shown in the related application DE 10 2007 039 758, this is quite possible with modern power electronics components however. The device according to the invention thus allows inductive plasma excitation at excitation frequencies up to three orders of magnitude below the high frequencies usually used for excitation. Whereas in most cases commercially available 13.56 MHz excitation sources are used for plasma excitation, an advantageous embodiment of the present invention comprises an induction switch with an excitation frequency of the AC signal of no more than 100 kHz, preferably no more than 50 kHz.

As explained in detail below, the comparatively low excitation frequencies allow the inductive generation of plasmas with very high charge carrier densities at low gas pressure. Owing to the high conductivity of the inductive trigger discharge, the induction switch according to the invention can be used over a very wide voltage range.

In a preferred embodiment, the induction switch comprises a high voltage source which is set up to provide a voltage of between 10 V and more than 100 kV between the outer electrode and the inner electrode.

The present invention also comprises a method for switching high voltages, in which a first voltage is applied to an inner electrode in the interior of a container filled with a gas, and a second voltage is applied to an outer electrode in the interior of the container, wherein the difference between the first and the second voltage corresponds to the voltage to be switched and wherein the outer electrode has at least one aperture, at least partially encloses the inner electrode and is separated from the inner electrode by an electrode gap. The method according to the invention further comprises the inductive generation of a plasma in a plasma generation region inside the container by generating an AC signal at a predefined excitation frequency in an inductor and the activation of a flow of charge between the outer electrode and the inner electrode by flooding the electrode gap with the plasma.

As shown above and explained below using an exemplary embodiment, the method according to the invention allows the switching of high currents in the kiloampere range at high reverse voltages up to several 100 kV with a gas discharge switch which requires only one electrode gap and avoids the problem of electrode erosion virtually completely.

The dwell time of the plasma ions in the electrode gap can preferably be controlled by selecting a length of the outer electrode. The switching parameters thus depend on technically simple variables which can be influenced precisely, such as the extraction voltage and the longitudinal extent of the electrode device, and can therefore be varied with comparatively little effort.

The method according to the invention allows the efficient switching of high voltages over a wide voltage range and at the same time avoids the problem of electrode erosion.

DETAILED DESCRIPTION

Further advantages and features of the device according to the invention and of the method according to the invention can be best understood using the detailed description of the drawings below, in which:

FIGS. 1*a* and 1*b* schematically show the principle of the inductive plasma generation;

1. PRINCIPLES OF INDUCTIVE PLASMA GENERATION

Figure 1A:
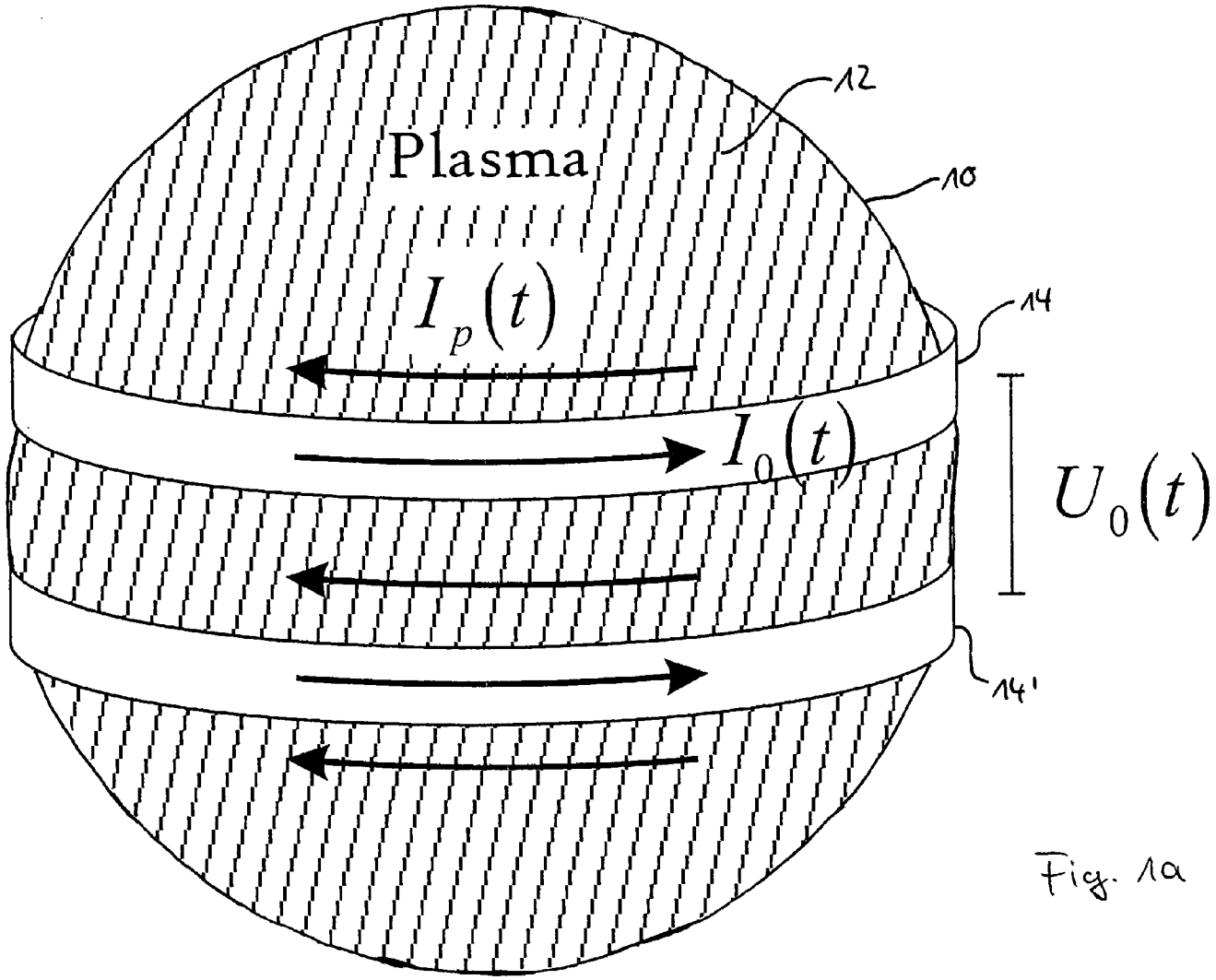

Inductively coupled plasmas have been generated and studied for more than 100 years, as described for example in J. Hopwood, "Review of Inductively Coupled Plasmas for Plasma Processing", Plasma Sources Science and Technology, I (1992), 109-116.

A device for inductive plasma generation comprises a container with a gas in which the plasma is to be generated, as well as an inductor, for example a coil, which can be coupled inductively to the gas. In inductive coupling, the inductor can be understood as the primary winding of a transformer, which generates a magnetic alternating field in the gas. If it is strong enough, the magnetic flux which changes over time can ignite and maintain a plasma in the gas. The discharge in the gas is an electrically conductive fluid, and the flow of charge in the plasma can be regarded as an individual secondary winding which, with the inductor as the primary winding, effectively forms a transformer.

Inductively generated discharge plasmas offer both technical and physical advantages over electrode-fed systems. Firstly, undesired sputter effects and the associated erosion of the electrode material and contamination of the discharge plasma are avoided. Secondly, the induced current density is not space-charge-limited and can (at least theoretically) assume any value. With high exciter currents, there is furthermore the possibility of generating an intrinsic plasma confinement (theta pinch). The initiation of an inductive charge plasma is however made more difficult by the fact that, in contrast to a linear discharge, an electrode-induced secondary emission of electrons, which could help boost the discharge, does not occur.

The inductive ignition of a gas discharge takes place precisely when the generation rate of ions exceeds the recombination rate due to electron impact ionisation. If the recombination rate inside the discharge volume compared to the vessel wall effects can be disregarded, the loss of free charge carriers is defined virtually exclusively by the diffusion thereof. When the discharge is initiated, the dissipation over time of the electron density disappears, and the charge carrier transport is described by the time homogeneous diffusion equation:

$$\nabla^2 n_e + \frac{\nu_{iz}}{D_a} n_e = S_e. \tag{1}$$

In equation (1), $n_e$ is the electron density, $D_a$ is the diffusion constant for the relevant particle type, $\nu_{iz}$ is the frequency for ionisation impacts and $S_e$ is the given source density for charge carriers in the discharge volume, which is largely independent of the current electron density.

Although the invention can be used in any discharge geometries, only exemplary embodiments with a spherical discharge geometry are considered in the present application. The ball-shaped discharge geometry has the advantage of particularly low charge carrier losses at the edge region of the plasma owing to the largest possible ratio of volume to surface area, so that plasmas with particularly high concentrations of charge carriers can be generated.

Figure 1B:
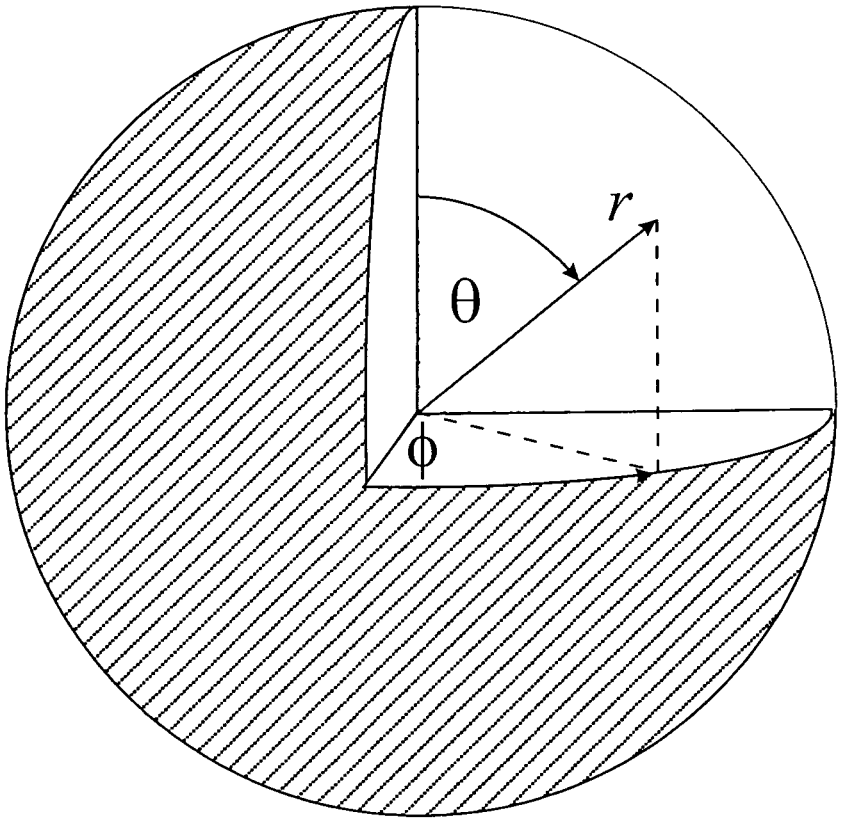

FIG. 1*a* schematically shows the principle of inductive discharge generation in a spherical container 10, which contains a gas 12 and is surrounded by a coil with two windings 14, 14'. FIG. 1*b* shows the spherical coordinate system (r, θ, Φ) used below to describe the inductive discharge generation of FIG. 1*a*.

According to Lenz's rule, the exciter current $I_0(t)$ in the induction windings 14, 14' induces an induction current $I_p(t)$ in the plasma, the magnetic field of which current being directed such that it counteracts the cause of the induction. To determine the ignition criterion as a function of gas pressure, a completely azimuthally symmetric and polar symmetric discharge geometry is assumed for the sake of simplicity. The electron density $n_e(r)$ is in this case dependent exclusively on the radial coordinate r. If a disappearing source density $S_e$ of charge carriers is also assumed, the diffusion equation assumes the form $$\frac{1}{r^2}\frac{d}{dr}\left\{r^2\frac{d}{dr}n_e(r)\right\}+\frac{\nu_{iz}}{D_a}n_e(r)=0. \quad (2)$$

A solution of equation (2) can be given as a linear combination of spherical Bessel functions $$n_e(r)=Aj_0(\alpha r)+By_0(\alpha r),\quad mit\ \alpha^2=\frac{\nu_{iz}}{D_a}. \quad (3)$$

The electron density disappears at the edge of the vessel wall, and thus the following applies to the radial distribution of the electron density $$n_e(r)=n_{e0}\frac{r_0}{\pi r}\sin\left(\frac{\pi}{r_0}r\right), \quad (4)$$

wherein $n_{e0}$ is a constant and $r_0$ is the radius of the container 10. Because $$\alpha^2=\frac{\nu_{iz}}{D_a},$$

the following condition applies $$\frac{\nu_{iz}}{D_a}=\frac{\pi^2}{r_0^2}. \quad (5)$$

With the average diffusion length $$\Lambda=\frac{r_0}{\pi},$$

equation (5) gives a relationship between the collision frequency for ionisation impacts $\nu_{iz}$ and the dimensions and geometry of the discharge vessel 10, which is referred to as the general ignition criterion for inductive discharge plasmas:

$$\nu_{iz}(E)=\frac{D_a}{\Lambda^2}. \quad (6)$$

The collision frequency ν, is a function of the level of the induced electric field strength E:

$$\nu_{iz}(E_{emf})=n_gX_{iz}(E_{emf}) \quad (7)$$

with the constant $n_g$ and the rate coefficient $X_{iz}$, which can be expressed in good approximation by an Arrhenius function for electron energies which are on average below the ionisation energy of the element (see M. A. Liebermann and A. J. Lichtenberg, "Principles of Plasma Discharges and Materials Processing", J. Wiley & Sons, New Jersey 2005):

$$X_{iz}(E_{emf})=X_0e^{-\frac{c_2p}{E_{emf}}}, \quad (8)$$

wherein p is the gas pressure set and $C_2$ is a coefficient which is dependent on the type of gas and can be determined experimentally in an analogous manner to the Paschen coefficient. A second parameter $$C_1=\frac{n_g\times X_0}{(D_a\times p)}$$

can likewise be defined in an analogous manner to Paschen's Law, so that the induced electric field strength $E_{emf}$ is given by combining equations (6) to (8) as a function of the set gas pressure p and the diffusion length Λ to $$E_{emf}=\frac{C_2p}{\ln(C_1p\Lambda^2)}. \quad (9)$$

The following ignition criterion for an inductive discharge plasma thus follows from Faraday's induction law:

$$L\dot{I}=\frac{C_2p\Lambda}{\ln(c_1p\Lambda^2)}, \quad (10)$$

wherein $\dot{I}$ is the rate of current rise and L is the inductance of the inductance coil. For the inductance L of an induction coil lying close to the discharge vessel 10, the following relationship applies $$L=\frac{\mu_0}{4\pi}C(N)r_0, \quad (11)$$

wherein C(N) is a dimensionless correction factor which is dependent on the number of windings. With the substitution $$\Lambda=\frac{r_0}{\pi},$$

a relationship between the rate of current rise necessary for initiating an inductive discharge and the dimensions of the discharge vessel and the set gas pressure thus follows from the ignition criterion of equation (10):

$$\dot{I}(r_0)=\frac{A_2p}{\ln(A_1pr_0^2)}, \quad (12)$$

wherein $A_1$ and $A_2$ summarise the constants. It follows from equation (12) that the necessary rates of current rise decrease with an increasing radius $r_0$. The rates of current rise of 0.1 kA/μs to 1 kA/μs associated with larger discharge vessels can be implemented with power semiconductors, whereas gas discharge switches are necessary for smaller vessel dimensions in order to apply the necessary rates of current rise. The rate of current rise according to equation (12) however passes through a minimum as a function of the gas pressure p, which is normal for Paschen curves. It could be demonstrated in experiments that the minimum of the rate of current rise necessary for igniting a discharge in an argon-filled spherical container of approx. 10 cm radius is at a pressure of approx. 3 Pa and is approximately 0.6 kA/μs. At rates of current rise of approx. 1 kA/μs, the gas pressure can be reduced to less than 1 Pa. Electron densities $n_e$ of $10^{14}/cm^3$ to $10^{15}/cm^3$ could be generated with the experimental structure.

The dependence of the electron density on the excitation frequency ν and on the geometry and dimensions of the discharge container follows the relationship presented in the related application DE 10 2007 039 758 and is briefly summarised below.

In an inductively coupled plasma discharge, the power of the electric field applied is generally transmitted within a certain skin depth δ, see for example J. T. Gudmundsson and M. A. Liebermann: "Magnetic Induction and Plasma Impedance in a Planar Inductive Discharge", Plasma Sources Science and Technology, 7 (1998) 83-95. In an impact-dominated plasma, i.e. in a plasma in which the frequency $\nu_c$ of the collisions between electrons and neutral gas particles is very much greater than the excitation frequency ν, it has been shown that a maximum efficiency of the coupling of energy occurs at a skin depth of $$\delta=0.57r_p \tag{13}$$

wherein $r_p$ is the radius of the plasma, which can be equated in good approximation with the radius of the discharge container: $r_p \approx r_0$. The above equation (13) is in turn derived from M. A. Liebermann and A. J. Lichtenberg: "Principles of Plasma Discharges and Materials Processing", Wiley & Sons, New Jersey 2005, and from J. Reece Roth: "Industrial Plasma Engineering Volume 1", IoP (Institute of Physics Publishing) 2003. This means that the skin depth is already essentially defined by the structural design. The following relationship applies to the density of the power absorbed by the plasma $\dot{w}_{abs}$:

$$\dot{w}_{abs} = \frac{\sigma_p}{2} E_{emf}^2, \tag{14}$$

wherein $E_{emf}$ is the electric field strength and $\sigma_p$ is the spatially and chronologically averaged conductivity of the plasma, for which the following applies:

$$\sigma_p = \frac{2}{\mu_0 \nu \delta^2}, \tag{15}$$

wherein ν is the excitation frequency. The following relationship is produced by inserting equations (13) and (15) into equation (14):

$$\dot{w}_{abs} \approx \frac{6.16}{\mu_0 \nu r_0^2} E_{emf}^2. \tag{16}$$

It can be seen from equation (16) that the power density absorbed by the plasma is inversely proportional to the excitation frequency ν. This means, then, that higher power densities can be achieved under otherwise equal conditions (such as induced field strength $E_{emf}$ and plasma radius $r_0$) with plasmas excited at low frequencies.

The result of equation (16) also allows an estimation of the achievable electron densities. Within the scope of application of equation (13), the electron density $n_e$ scales linearly with the power supplied, as has been confirmed experimentally for example by J. Hopwood et al.: J. Vac. Sci. Technol. A11: 152, (1993). The following then applies to the power dissipated in the plasma:

$$\dot{W}_{diss}=n_e u_B A_{eff} W_T, \tag{17}$$

wherein $u_B$ is the Bohm speed, $A_{eff}$ is the effective surface area of the discharge container and $W_T$ is the total energy loss per pair of charge carriers generated according to Liebermann and Lichtenberg (see above), which is composed of radiation losses and losses of kinetic energy which occur when the charge carriers reach the vessel wall. The "effective surface area" $A_{eff}$ corresponds to the geometric surface area in spherical containers, but in other vessel shapes, for example cylindrical vessels, can be approximately 10% less than the geometric surface area.

The dissipated power $\dot{W}_{diss}$ according to equation (17) must correspond to the total power absorbed in the plasma because of conservation of energy. The total absorbed power $\dot{W}_{abs}$ corresponds to the volume integral over the power density of equation (16), which can however be approximated in a qualitative consideration by multiplying the power density of equation (16) with the volume $V_p$ of the plasma, which produces the following:

$$\dot{W}_{abs} \approx E_{emf}^2 \frac{6,16}{\mu_0 \nu r_0^2} V_p. \tag{18}$$

By equating equations (17) and (18) (conservation of energy), the following approximate expression for the electron density is obtained:

$$n_e \approx E_{emf}^2 \frac{6,16}{\mu_0 \nu r_0^2} \frac{V_p}{u_B A_{eff} W_T}. \tag{19}$$

As can be seen in equation (19), the electron density $n_e$ is in fact inversely proportional to the excitation frequency ν, which in turn means that higher electron densities $n_e$ can be obtained at lower excitation frequencies. It can further be seen that the electron density $n_e$ is proportional to the ratio between the volume $V_p$ and the effective surface area $A_{eff}$. This means firstly that higher electron densities can be achieved with larger containers. Secondly, this means that a ball-shaped, i.e. spherical container geometry, in which the ratio of volume to surface area is maximal, is likewise advantageous for achieving a high electron density $n_e$.

2. PLASMA EXTRACTION

A flat and impact-free edge layer, what is known as a Debye layer, forms in the plasma generation region in front of the conductive walls of a discharge vessel as it forms the outer electrode 24. A necessary condition for building up such an edge layer is the fulfilment of what is known as the Bohm Criterion for the speed $v_0$ at which the ions at the layer edge enter the edge layer:

$$v_0 \geq u_B := \sqrt{\frac{k_B T_e}{m_i}}, \tag{20}$$

wherein $T_e$ is the thermal electron temperature and $m_i$ is the ion mass. The speed $u_B$ is referred to as the Bohm speed. The entry of electrons into the edge layer of the plasma generation region at the Bohm speed $u_B$ results in a Bohm diffusion current with the charge current density $$j_B = e \cdot n_e \cdot u_B. \tag{21}$$

The space charge current density within the electrode system however follows the Schottky-Langmuir law of space charge. The following applies to a cylindrical electrode arrangement:

$$j_{SL} = \frac{4}{9}\varepsilon_0 \sqrt{\frac{Ze}{m_i}} \frac{U^{\frac{2}{3}}}{d^2}, \tag{22}$$

wherein $\in_0$ is the dielectric constant, U is the acceleration voltage, Z is the charge number of the ions and d is the distance between the anode and the cathode.

In order to achieve immediate discharge breakdown over a very wide voltage range of from 10 V to a few 100 kV when the generated plasma enters the electrode gap, the Bohm charge current density $j_B$ should greatly exceed the Schottky-Langmuir charge current density $j_{SL}$:

$$j_B >> j_{SL}. \tag{23}$$

The advantageous effects according to the invention are produced in particular when the Bohm charge current density $j_B$ exceeds the Schottky-Langmuir charge current density $j_{SL}$ by one to two orders of magnitude. Equation (23) can be fulfilled by selecting a suitably high electron density $n_e$, which according to equation (19) and equation (9) can be achieved by selecting a low excitation frequency ν or high field strengths $E_{emf}$.

If low excitation frequencies ν are used, charge carrier densities can be achieved at very low pressures and reasonable rates of current rise, which bring about immediate breakdown of the gap and thus closing of the switch over a very wide voltage range when the plasma enters the discharge gap through the aperture.

3. EXEMPLARY EMBODIMENT

Figure 2:
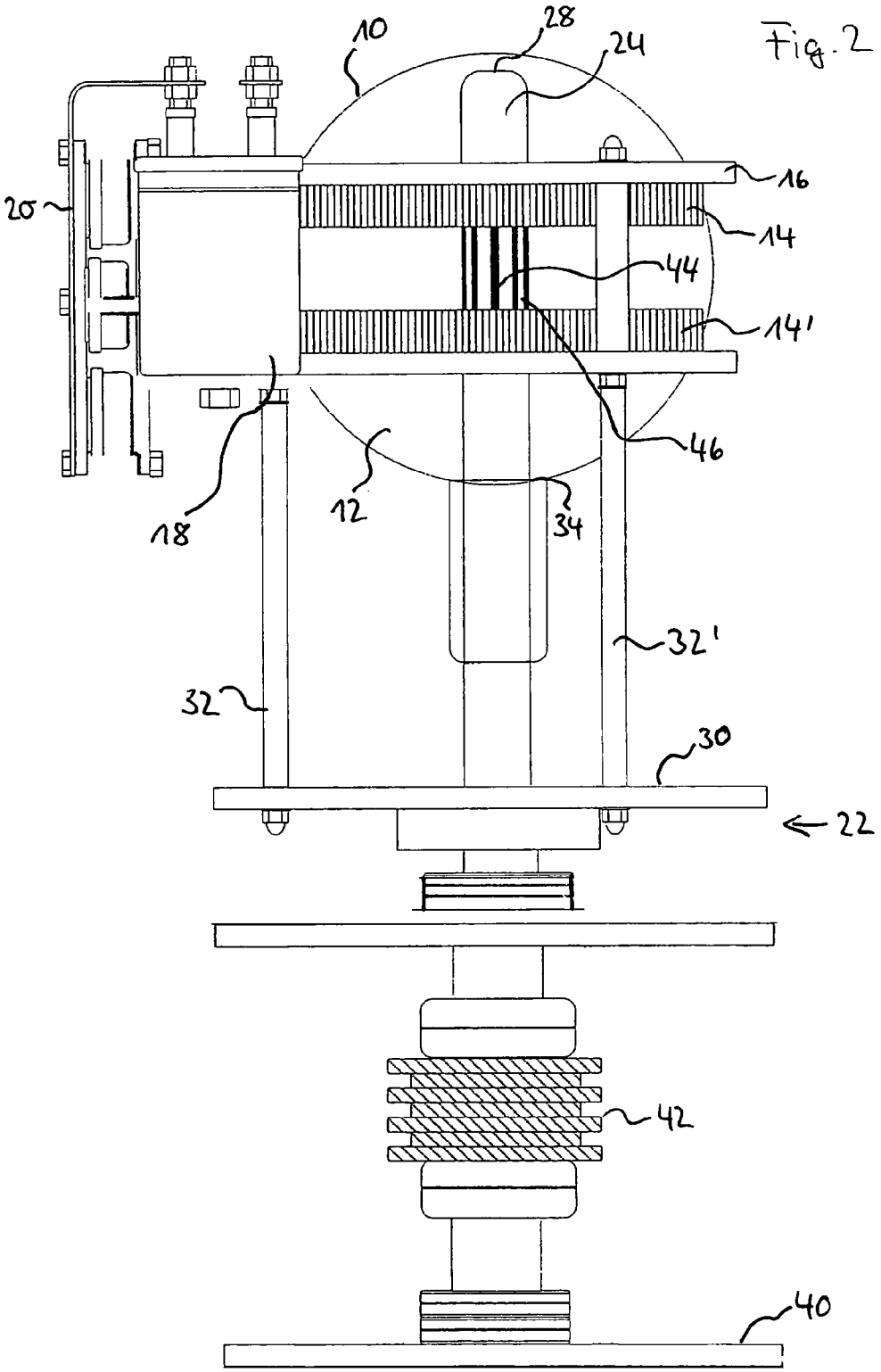
FIG. 2 shows the schematic structure of an induction switch according to the invention, with a container, an inductor, a power source and an electrode device with an electrode gap.
Figure 3:
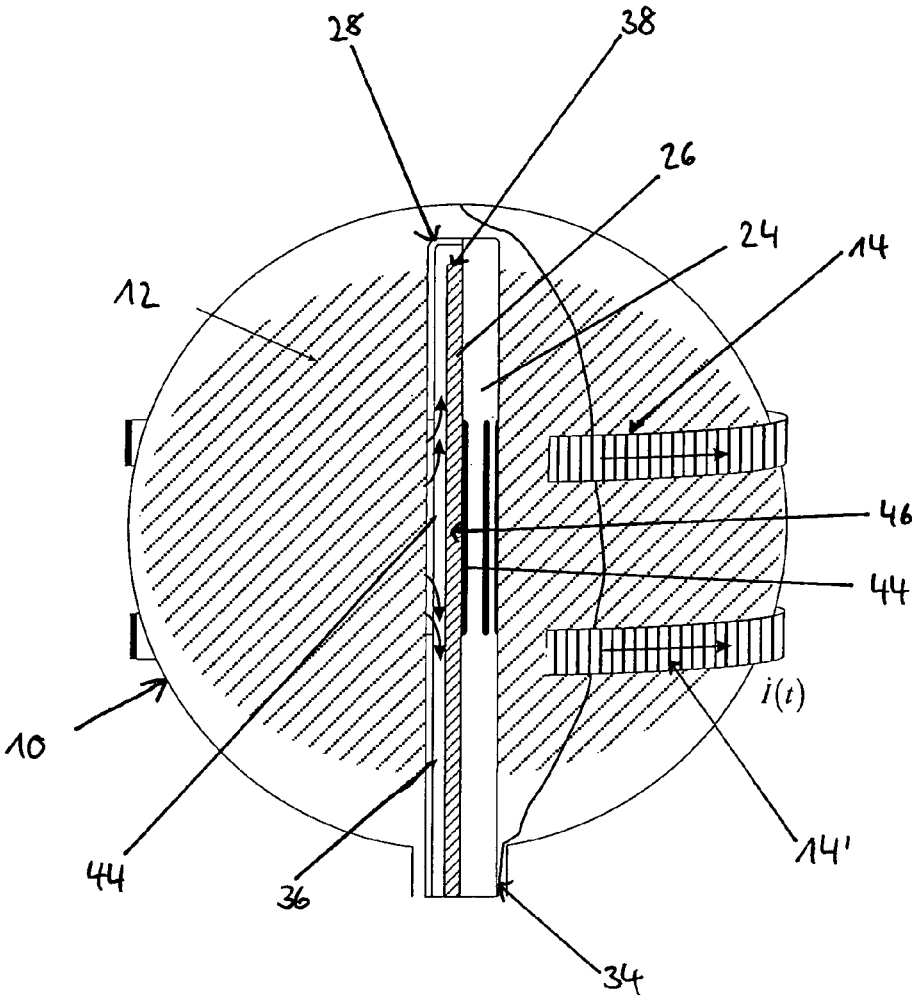
FIG. 3 shows a partial view of the electrode device with the electrode gap of FIG. 2.
Figure 4:
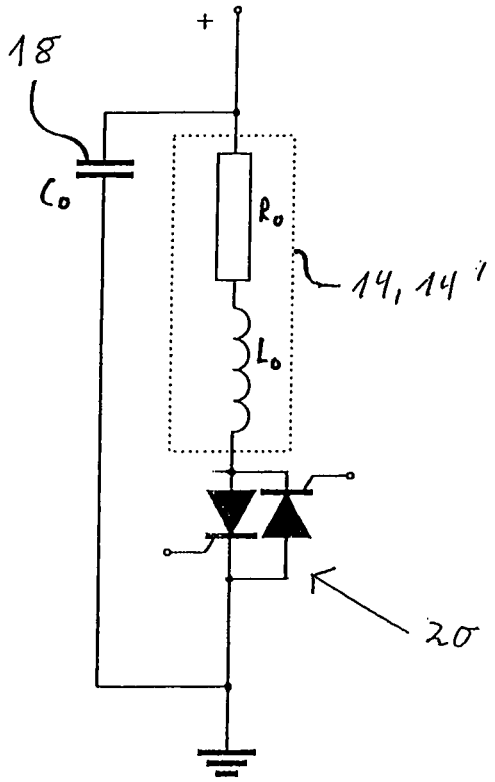
FIG. 4 shows an equivalent circuit diagram of the plasma generation device of FIGS. 2 and 3.

FIG. 2 shows an induction switch constructed according to the above-explained principles, in a schematic diagram. A section which illustrates the discharge vessel and the electrode device in a sectional diagram is shown in FIG. 3, whereas FIG. 4 shows an equivalent circuit diagram of the plasma generation devices shown in FIGS. 2 and 3. In all figures, the same or similar components are provided with the same reference symbols.

The spherical discharge container 10 with approx. 20 cm diameter contains an argon gas 12 at a pressure of 1 to 10 Pa. The invention is however not limited to the pressure range given. In alternative embodiments, pressures in particular in the range between 0.1 Pa and 100 Pa can be used. The discharge container is surrounded in its equatorial region with a coil, which comprises two windings 14, 14' of an approx. 20 mm wide copper strip and is mounted on a coil holder 16 consisting of an electrically insulating material. The two windings 14, 14' are coupled to each other by electrically conductive connection elements, which are not shown in FIG. 2 and FIG. 3 for reasons of clarity. The two windings 14, 14' together form a coil with a total inductance of approx. 1 μH.

As can be seen in FIG. 2, two capacitors are parallel-connected to form a capacitor bank 18 outside the discharge container 10. The capacitor bank 18 has a total capacitance of approximately 10 μF in the exemplary embodiment shown and is connected via a first connection to a voltage supply unit (not shown). During operation, the capacitors are charged up via the first connection to a precharge voltage of approximately 3500 V.

The capacitor bank 18 is connected to a first end of the induction coil via a second connection. The opposite end of the coil is coupled to a switching element 20, which comprises two parallel-connected type SKT552/16E disc thyristors in the arrangement shown in FIG. 2. Rates of current rise of up to 2 kA/μs can be achieved with reasonable outlay in this manner. The close spatial proximity of the capacitors and thyristors to the coil system helps to keep the energy losses in the primary circuit low.

FIG. 4 shows an equivalent circuit diagram of the plasma generation devices illustrated in FIGS. 2 and 3, wherein the windings 14, 14' of the induction coil are represented by a series-connection of an inductor $L_0$ and an ohmic resistor $R_0$.

To induce a plasma, the capacitor bank 18 is charged up with the charge voltage of approx. 3500 V at a time t=0. In alternative embodiments, the charge voltage is between 1 kV and 10 kV. The thyristors of the switching element 20 are then switched into a conductive state by means of a control signal, so that the capacitor bank discharges through the coil windings 14, 14'. The discharge current reaches maximum current strengths of approx. 2 kA and rates of current rise of more than 2 kA/μs. As explained above, the rapid rise in current in the discharge gas 12 inside the discharge container 10 generates a magnetic flux which changes greatly over time and itself generates an electric field which is sufficient to ignite a plasma in the discharge container 10.

As the plasma discharge can be considered an electrically conductive fluid which is surrounded by the coil 14, 14', it forms the secondary winding of an imaginary transformer. The capacitor bank 18 with total capacitance C and the coil 14, 14' with the inductor $L_0$ and the ohmic resistor $R_0$ form a damped electric series oscillator circuit, so that the voltage in the capacitor bank 18 oscillates at a frequency ν and the current circulates at the same frequency between the capacitor bank and the inductor. In the embodiment described here, an oscillator circuit frequency of approx. 50 kH is produced, which is at the same time the excitation frequency of the plasma. The oscillation of the oscillator circuit lasts for around 100 to 200 μs, during which the plasma is ignited and maintained.

With the described structure, a plasma with a high electron density can be generated by inductive coupling at an excitation frequency which is around three orders of magnitude below the usual excitation frequencies.

If the plasma is extinguished, the capacitor bank 18 is charged up again until the switching element 20 is switched into the conductive state again by a further control signal.

In modified embodiments, ignitrons or IGBTs can be also used in the switching element 20 instead of thyristors. Such alternative embodiments are described in further detail in the related application DE 10 2007 039 758, to which reference is made here.

As shown in FIG. 2 and the detailed drawing of FIG. 3, the induction switch according to the invention furthermore has an electrode system 22 with a cylindrical outer electrode 24, which coaxially encloses a likewise cylindrical inner electrode 26.

The common cylinder axis of the outer electrode 24 and the inner electrode 26 runs through the centre point of the spherical discharge container 10 and lies perpendicular to the two planes spanned by the windings 14, 14'. In the embodiment shown, the outer electrode 24 is configured as a hollow circular cylinder with an outer diameter of approx. 2.5 to 3 cm and accommodated inside the discharge container 10 with an upper end 28 which is adjacent to the north pole of the discharge container 10. The lower end of the outer electrode opposite the upper end 28 lies outside the discharge container 10 and is connected to ground potential as the anode connection 30. The anode connection 30 is connected to the coil windings 14, 14' via connecting rods 32, 32' so that the coil arrangement is likewise at ground potential.

The routing of the electrode system 22 through the outer wall of the discharge container 10 is sealed off from the ambient atmosphere by a flange 34 at the south pole of the discharge container.

As can be seen in the sectional diagram of FIG. 3, the inner electrode 26 is formed as a solid circular cylinder inside the outer electrode 24 and separated from the outer electrode 24 by a 4 to 5 mm wide electrode gap 36. In the embodiment shown, an upper end 38 of the inner electrode 26 lies 6 to 8 mm below the upper end 28 of the outer electrode 24 in the vicinity of the north pole of the discharge container 10, whereas a lower end of the inner electrode 26 opposite the upper end 38 lies outside the discharge container and is coupled to a cathode connection 40 which is separated from the anode connection 30 of the outer electrode 24 by a high voltage insulator 42.

The electrode gap 36 is connected to the interior of the discharge container 10 by a plurality of slot-shaped apertures 44 which are formed at regular intervals along a circumferential direction of the outer electrode 24. The length of the apertures 44 in the axial direction corresponds to the extent of the section of the discharge container 10 surrounded by the coil windings 14, 14', approximately 5 to 6 cm in the exemplary embodiment shown. The width of the apertures is essentially less and in the embodiment shown is only 0.2 to 0.3 cm. Two adjacent apertures 44 are each separated by a web 46, the width of which in the circumferential direction of the outer electrode 24 is three to five times greater than the width of the aperture 44.

During operation of the high voltage switch, the voltage to be switched, which can be between 10 V and several 100 kV, is applied between the anode connection 30 and the cathode connection 40, so that an electric field is formed between the outer electrode 24 and the inner electrode 26, which field spans the electrode gap 36. The flow of current is initially interrupted by the electrode gap 36; the switch is closed. Owing to the low gas pressure and the comparatively great distance between the outer electrode 24 and the inner electrode 26, reverse voltages up to more than 500 kV can be achieved with the electrode system according to the invention.

If a dense discharge plasma is then generated inductively in the discharge container 10 by the above-described method, the plasma ions formed are accelerated in the direction of the common cylinder axis of the outer electrode 24 and the inner electrode 26, i.e. radially inwards, owing to the electric field applied between the outer electrode 24 and the inner electrode 26, and enter the electrode gap 36 through the apertures 44. The Lorentz forces effective during the inductive plasma generation promote forced penetration of the plasma into the gap space. A higher pressure is quickly produced in the gap space, so that the working point of the switch is shifted towards the Paschen minimum during the discharge phase. In the embodiment shown and with the above-described parameter values, a Bohm charge density $n_e$ in the range from $10^{19}$ to $10^{21}$ $M^{-3}$ is produced and thus, according to equation (21), a charge current density $j_B$ which exceeds the Schottky-Langmuir charge current density $j_{SL}$ of the above-described electrode system by at least two orders of magnitude. The condition of equation (23) is thus fulfilled.

The flooding of the electrode gap 36 with a plasma of very high electron density and conductivity, even with a comparatively low potential difference of a few 10 V, results in immediate flashover of the gap and thus to closing of the switch.

The initiated discharge is only extinguished when both the induction trigger and the main discharge have ended. Quenching of the switch at low currents can be avoided by adapting the duration of the triggering and thus the generation of the plasma in the rear discharge space to the actual switching process.

The above-described exemplary embodiments and the figures only serve for illustration and are not intended to limit the invention in any way. The scope of protection of the induction switch according to the invention and of the method according to the invention for switching high currents is given solely by the claims below.

REFERENCE LIST

10 Discharge container
12 Discharge gas
14, 14' Windings of induction coil
16 Coil holder
18 Capacitor bank
20 Switching element
22 Electrode system
24 Outer electrode
26 Inner electrode
28 Upper end of outer electrode 24
30 Anode connection
32, 32' Connecting rods
34 Flange
36 Electrode gap
38 Upper end of inner electrode 26
40 Cathode connection
42 High voltage insulator
44 Apertures
46 Web

The invention claimed is:

1. An induction switch comprising:
a container with a gas, in which a plasma is to be generated;
an inductor, which can be coupled inductively to the gas;
a power source for generating an AC signal in the inductor; and
an electrode device inside the container with an electrode gap between an inner electrode and an outer electrode, which has at least one aperture and at least partially encloses the inner electrode;
wherein the power source comprises at least one capacitor, which can be charged to an operating voltage, and at least one switching element, which can be switched into a conductive state and is connected in such a manner that the at least one capacitor can discharge through the inductor when the switching element is in the conductive state.

2. The induction switch according to claim 1, in which the inner electrode and the outer electrode are cylindrical and the outer electrode at least partially coaxially encloses the inner electrode.

3. The induction switch according to claim 2, in which the outer electrode is a hollow circular cylinder and the inner electrode is a hollow or solid circular cylinder.

4. The induction switch according to claim 2, in which the container is spherical or approximately spherical, and the cylinder axis of the outer electrode runs through the centre point of the sphere.

5. The induction switch according to claim 1, in which the width of the electrode gap is more than 2 mm, preferably more than 4 mm.

6. The induction switch according to claim 1, with a plurality of apertures along an axial direction of the outer electrode, wherein in each case two apertures are separated by a web.

7. The induction switch according to claim 1, in which the gas comprises an inert gas, preferably argon, and the gas pressure is less than 30 Pa, preferably less than 10 Pa.

8. The induction switch according to claim 1, in which the inductance L of the inductor is 0.5 μH to 10 μH, preferably 1 μH to 6 μH.

9. The induction switch according to claim 1, in which the inductor comprises a coil which surrounds the container.

10. The induction switch according to claim 9, wherein the coil has a number of windings between two and four.

11. The induction switch according to claim 9, in which the length of the apertures along an axial direction of the outer electrode corresponds to the extent of a section of the container which is surrounded by the coil.

12. The induction switch according to claim 1, wherein the at least one capacitor and the inductor form components of an electrical oscillator circuit which is not overdamped, the natural frequency of which corresponds to a frequency of the AC signal.

13. The induction switch according to claim 1, wherein the switching element comprises at least one thyristor or at least one IGBT or at least one gas discharge switch.

14. The induction switch according to claim 1, wherein the at least one capacitor or a plurality of parallel-connected capacitors has or have a total capacitance of 1 μF to 100 μF, preferably 6 μF to 20 μF.

15. The induction switch according to claim 1, in which the power source is suitable for generating an AC signal with an excitation frequency of no more than 100 kHz, preferably no more than 50 kHz in the inductor.

16. The induction switch according to claim 1, with a high voltage source which is set up to provide a voltage of between 10 V and more than 100 kV between the outer electrode and the inner electrode.

17. A method for switching high voltages, the method comprising:

applying a first voltage to an inner electrode which is accommodated inside a container filled with a gas;

applying a second voltage to an outer electrode which is accommodated inside the container, wherein the difference between the first and the second voltage corresponds to the voltage to be switched and wherein the outer electrode has at least one aperture, at least partially encloses the inner electrode and is separated from the inner electrode by an electrode gap;

inductively generating a plasma in a plasma generation region inside the container by generating an AC signal at a predefined excitation frequency in an inductor; and activating a flow of charge between the outer electrode and the inner electrode by flooding the electrode gap with the plasma;

wherein the AC signal is generated by charging up a capacitor to an operating voltage and switching at least one switching element into a conductive state so that the capacitor discharges through the inductor.

18. The method for switching high voltages according to claim 17, wherein the width of the electrode gap is more than 2 mm, preferably more than 4 mm.

19. The method for switching high voltages according to claim 17, wherein the outer electrode comprises a plurality of apertures along an axial direction of the outer electrode and in each case two apertures are separated by a web.

20. The method for switching high voltages according to claim 17, wherein the activation of the flow of charge comprises the acceleration of plasma ions through the aperture or apertures.

21. The method for switching high voltages according to claim 17, wherein the inner electrode and the outer electrode are cylindrical or ellipsoidal or spherical.

22. The method for switching high voltages according to claim 17, wherein the container is spherical or approximately spherical.

23. The method for switching high voltages according to claim 17, wherein the at least one capacitor and the inductor form components of an electrical oscillator circuit which is not overdamped, the natural frequency of which corresponds to a frequency of the AC signal.

24. The method for switching high voltages according to claim 17, wherein an excitation frequency of the AC signal is selected to be no greater than 100 kHz.

25. The method for switching high voltages according to claim 17, wherein an excitation frequency of the AC signal is selected to be no greater than 50 kHz.

* * * * *